US010779584B1

(12) United States Patent
Smith

(10) Patent No.: US 10,779,584 B1
(45) Date of Patent: Sep. 22, 2020

(54) APPAREL FOR INDIVIDUALS WITH LIMITED MOBILITY

(71) Applicant: Petronella Smith, Sugarland, TX (US)

(72) Inventor: Petronella Smith, Sugarland, TX (US)

( * ) Notice: Subject to any disclaimer, the term of this patent is extended or adjusted under 35 U.S.C. 154(b) by 21 days.

(21) Appl. No.: 16/152,493

(22) Filed: Oct. 5, 2018

(51) Int. Cl.

| | |
|---|---|
| ***A41D 1/14*** | (2006.01) |
| ***A41D 27/20*** | (2006.01) |
| ***A41D 5/00*** | (2006.01) |
| ***A41D 13/12*** | (2006.01) |

(52) U.S. Cl.
CPC ..... *A41D 1/14* (2013.01); *A41D 5/00* (2013.01); *A41D 13/129* (2013.01); *A41D 13/1254* (2013.01); *A41D 27/205* (2013.01); *A41D 2300/22* (2013.01); *A41D 2300/32* (2013.01); *A41D 2400/44* (2013.01); *A41D 2400/70* (2013.01)

(58) Field of Classification Search
CPC .... A41D 13/129; A41D 13/1254; A41D 5/00; A41D 1/14; A41D 25/04; A41D 25/06; A41D 2300/30; A41D 2300/32; A41D 2300/326; A41D 2300/332; A41F 9/00
USPC ..... 2/211, 221, 219, 214, 65, 69.5, 114
See application file for complete search history.

(56) References Cited

U.S. PATENT DOCUMENTS 887,589 A * 5/1906 Cohen
887,610 A * 5/1908 Epstein
929,476 A * 7/1909 Padernachts
1,530,504 A * 3/1925 Lenkowsky ..... A41D 1/14 2/211
D130,476 S * 11/1941 Silson ..... D2/852
3,500,478 A * 3/1970 Foster ..... A41F 9/025 2/221
3,727,238 A * 4/1973 Wolfson ..... A41D 13/1254 2/69
3,859,667 A * 1/1975 Roy ..... A41D 1/06 2/212
4,803,740 A * 2/1989 Dawson ..... A41D 1/21 2/215
4,914,756 A * 4/1990 Grassick ..... A41D 1/06 2/227
5,636,386 A * 6/1997 Salamone ..... A41D 1/14 2/211
6,374,415 B1 * 4/2002 Lenart ..... A41D 13/1236 2/114
6,859,940 B1 * 3/2005 Sholander ..... A41D 7/008 2/46
8,763,164 B2 * 7/2014 MacGillivray ..... A41D 1/06 2/221
D712,630 S * 9/2014 Jones ..... D2/826
9,364,035 B1 * 6/2016 Shachaf ..... A41D 15/00
(Continued)

*Primary Examiner* — Gloria M Hale
(74) *Attorney, Agent, or Firm* — Sanchelima & Associates, P.A.; Christian Sanchelima; Jesus Sanchelima

(57) ABSTRACT

An apparel including an apparel body having an operative top edge and an operative bottom edge is disclosed. At least one waist securing portion is defined adjacent the operative top edge of the apparel body, wherein the waist securing portion includes a resilient band. Securing members are provided on the waist securing portion to allow a user to easily wear or remove the apparel, wherein the securing members includes at least one of a hook and loop straps and a button and button loop set. The apparel further includes at least one pocket provided on an inner surface of the skirt body.

13 Claims, 5 Drawing Sheets

(56) References Cited

U.S. PATENT DOCUMENTS

| | | | | |
|---|---|---|---|---|
| 2004/0210987 | A1* | 10/2004 | Carney | A41D 1/21 2/236 |
| 2007/0214546 | A1* | 9/2007 | Roeger, III | A41D 1/14 2/211 |
| 2007/0271675 | A1* | 11/2007 | Eraca | A41D 1/215 2/104 |
| 2010/0017933 | A1* | 1/2010 | Taylor-Barry | A41D 13/1254 2/83 |
| 2012/0068033 | A1* | 3/2012 | Uffens | A44B 99/00 248/309.1 |

* cited by examiner

APPAREL FOR INDIVIDUALS WITH LIMITED MOBILITY

BACKGROUND OF THE INVENTION

1. Field of the Invention

The present disclosure relates to an apparel. In particular, the present disclosure relates to an apparel that can be used by women with limited mobility.

2. Description of the Related Art

Women with limited mobility find it very difficult to undress while addressing their personal toilet needs. Hence there is need for an apparel that women with limited mobility can remove easily and with confidence.

This apparel removes many of the obstacles experienced by caregivers while assisting patients with their bathroom needs, allowing them to more effectively care for their patients.

Several designs for apparels for patients have been designed in the past. None of them, however, are known to be easily removable by patients with limited mobility.

Applicant believes that a related reference corresponds to U.S. Patent Publication No. 20040210987 filed by INGRID CARNEY. The Carney reference discloses maternity wear that accommodates the changing shape of a woman's body during pregnancy, thereby minimizing the need for maternity clothes. However, the Carney reference fails to disclose any apparel that addresses the sensitive needs of women with limited mobility.

Another related application is U.S. Patent Publication No. 20100017933 filed by ELIZABETH LIDE TAYLOR-BARRY. The Barry reference discloses a modular medical apparel for use by patients during medical care and treatment, which provides comfort, dignity, easy dressing and access to the body without unnecessary body exposure. However, the Barry reference fails to disclose any apparel that addresses the sensitive needs of women with limited mobility, which can be undone very easily.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide an apparel for women with limited mobility.

It is yet another object of the present invention to provide an apparel for women with limited mobility which is easy to wear as well as easy to undo.

It is yet another object of the present invention to provide an apparel for women with limited mobility wearing which the women can be comfortable without having the constant feeling that some part of their body is getting exposed, as is the case with the conventional hospital gowns in which the back of the patients is completely bare.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
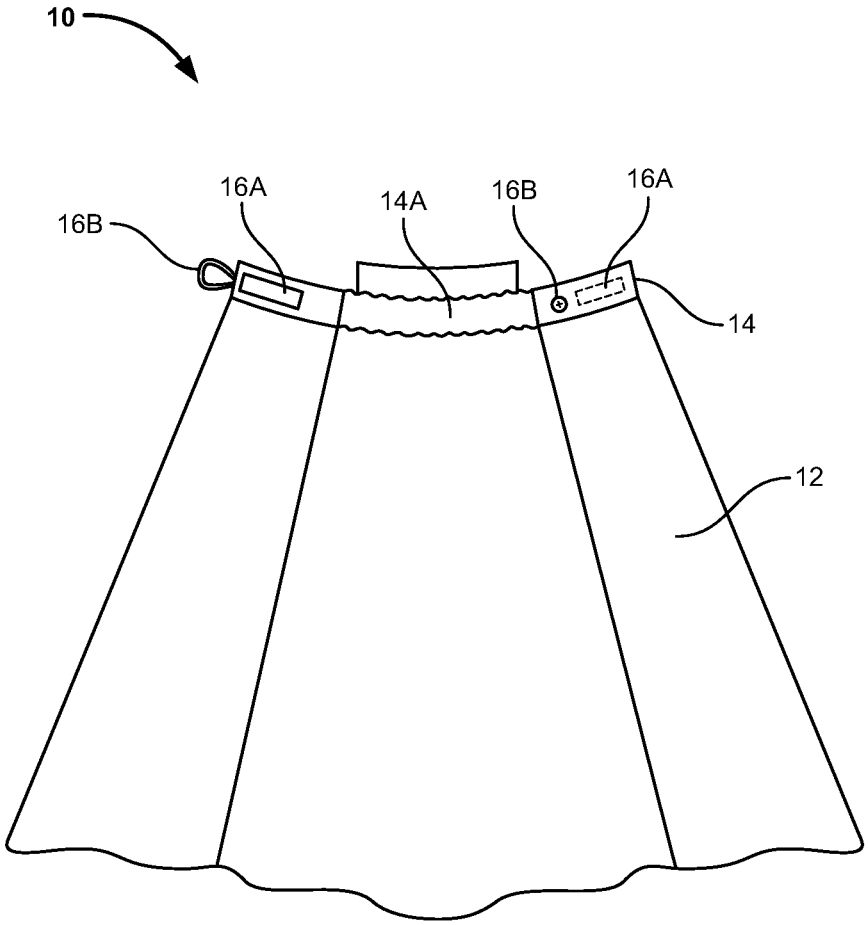
FIG. 1 represents a schematic view of an apparel 10 for women with limited mobility which comprises an apparel body 12 having a waist securing portion 14, and securing means 16A, 16B provided on the waist securing portion 14.

Referring now to the drawings, FIGS. 1-5, where the present invention is generally referred to with numeral 10, it can be observed that an apparel for women with limited mobility 10 (hereinafter also referred to as apparel 10) comprises an apparel body 12. On the apparel body 12 is provided at least one waist securing portion 14. The waist securing portion 14 is the portion of the apparel 10 that can be secured to the waist of a woman with limited mobility or any other patient for that matter. In an embodiment, the apparel 10 is a skirt, as illustrated in FIG. 1 thru FIG. 5. In an embodiment, the apparel 10 is a skirt that is either a knee length skirt or a full length skirt. The apparel 10 further comprises securing means 16A, 16B provided on the waist securing portion 14.

In an embodiment, the waist securing portion 14 is provided on an operative top edge 12A of apparel body 12. In another embodiment, the waist securing portion 14 can include two or more waist bands (waist securing portion 14) for securely fitting onto the waist of the patient. The waist securing portion 14 further includes a resilient band 14A. The resilient band 14A has elastic properties, which allows the use of a single skirt on patients of different body types.

The securing means 16A, 16B, in accordance with the present invention, are means that can be fastened and unfastened with extreme ease. The purpose is to have patients with limited mobility complete freedom and ability to undress themselves without any assistance for catering their toilet needs. Even in cases where the patient is completely immobile, having such easy to fasten and unfasten securing means make the caregiver's job easy to dress and undress the patient.

In one embodiment, the securing means 16A are hook and loop straps. Hook and loop straps can be provided in the form of continuous strips or intermittent strips, as per the patient's preference and application requirements. In some embodiments of the apparel 10, only securing means 16A in the form of hook and loop straps are provided on the waist securing portion 14.

In another embodiment, the securing means 16B is a button and button loop set. The apparel 10, in one embodiment, can include only the securing means 16B as means for fastening the skirt to the waist of the patient.

Figure 2:
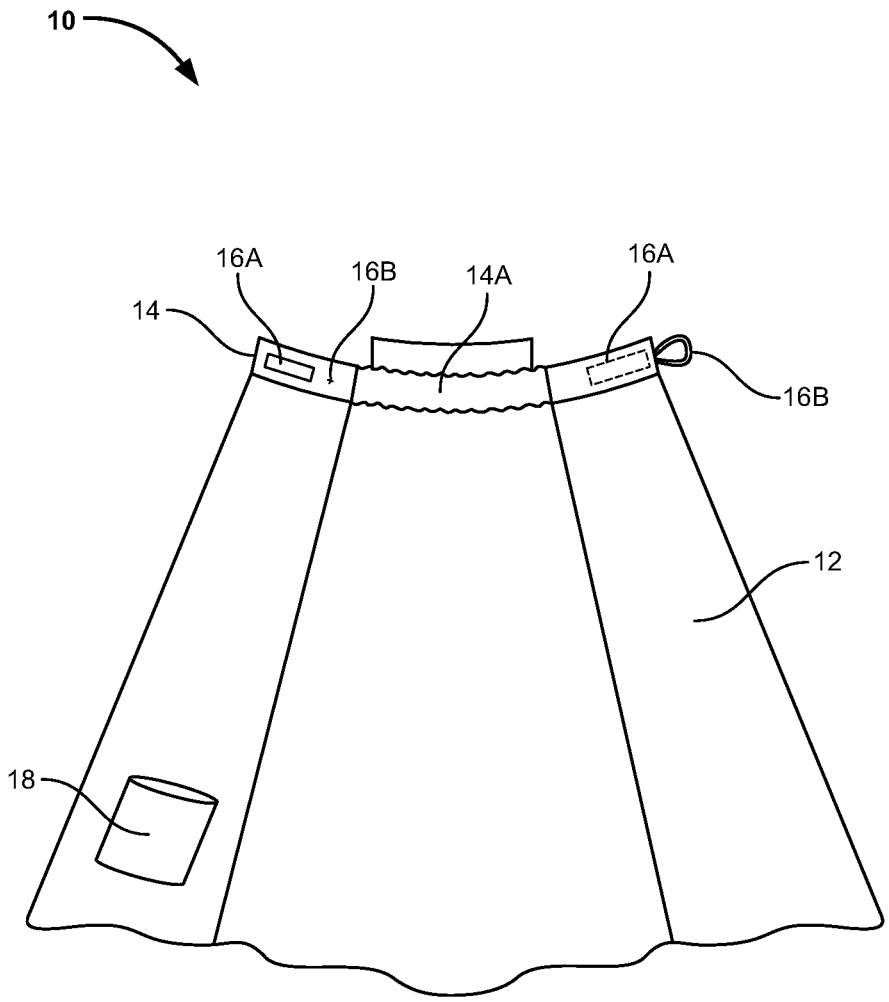
FIG. 2 illustrates another schematic view of the apparel 10, in which the inner surface of the apparel body 12 is seen having a pocket 18.

In yet another embodiment, the apparel 10 can include both the securing means 16A, 16B, as illustrated in FIG. 1 and FIG. 2. The presence of both the securing means 16A, 16B gives the patient an element of choice to select the securing means which they feel they are more comfortable with. Furthermore, providing two securing means 16A, 16B also gives a sense of security to the patient that apparel 10 has been securely worn on their bodies, with any chance of accidental removal of the apparel 10 being reduced.

In an embodiment, as seen in FIG. 2, the apparel 10 includes at least one pocket 18 provided on the inner surface of the apparel body 12. The pocket 18 can be used to hold anything that the patient would want to have on themselves, e.g., a foley catheter. In another embodiment, a pocket can also be provided on the outer surface of the apparel body 12. The outer pocket can be used to contain a cellphone or a caller bell.

In an embodiment, the apparel body 12 of the apparel 10 can be provided with a warmth providing surface on the inner side thereof. This feature provides dual functionality to the apparel 10, i.e., the apparel 10 is a skirt as well as a blanket for the patient. The warmth providing surface can be any surface known in the art, e.g., fur.

Figure 3:
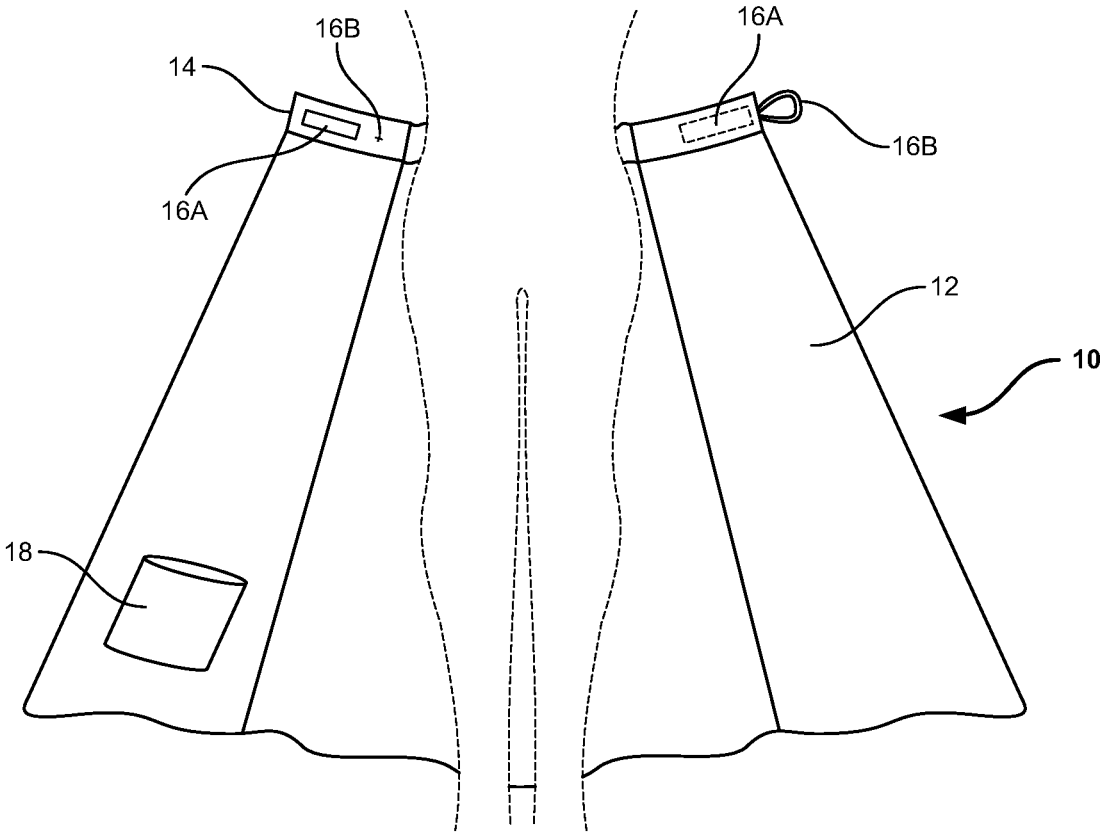
FIG. 3 illustrates a schematic view illustrating the first step involved in wearing the apparel 10, which is holding the apparel 10 such that the securing means 16A, 16B provided on the apparel 10 can be accessed near the abdominal area of the patient.
Figure 4:
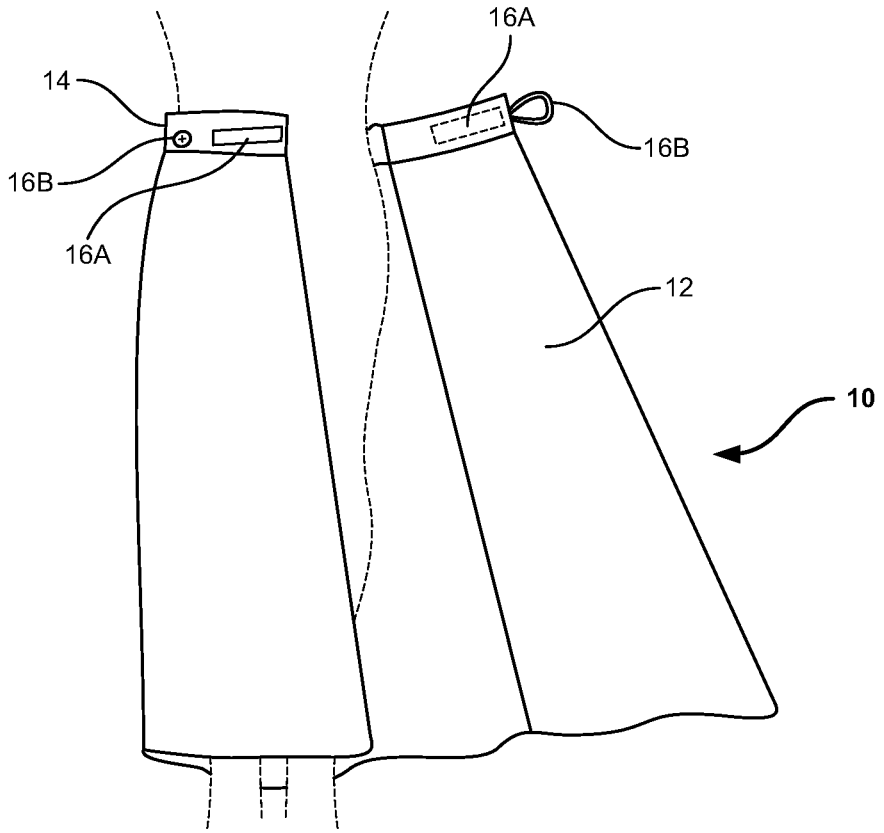
FIG. 4 illustrates a schematic view illustrating the second step involved in wearing the apparel 10, in which half of the apparel 10 is draped on the body of the patient.
Figure 5:
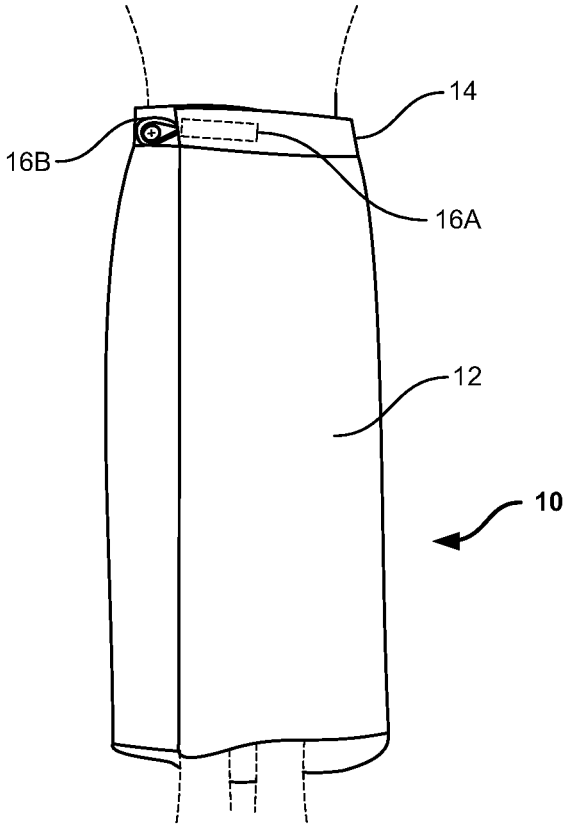
FIG. 5 illustrates a schematic view illustrating the second step involved in wearing the apparel 10, in which the remaining half of the apparel 10 is draped on the body of the patient, subsequent to which the securing means 16A, 16B are engaged.

Reference is now directed to FIG. 3 thru FIG. 5. As seen in FIG. 3 thru FIG. 5, the method of wearing the apparel 10 has been illustrated. The first step of wearing the apparel 10 involves holding the apparel 10 around the body in a manner that the securing means 16A, 16B can be accessed by the user around the naval or the abdominal area. The second step involves draping a first half of the skirt on the body. The third step involves draping the remaining half of the skirt on the body. The final step is to engage the securing means 16A, 16B provided on the waist securing portions for fitting the skirt on the body of the patient.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparel for individuals with limited mobility, the apparel comprising:

a. an apparel body having an operative top edge and an operative bottom edge, said apparel body further defined by a center portion and outer portions;

b. at least one waist securing portion defined adjacent the operative top edge of the apparel body, said at least one waist securing portion extending an entire width of said apparel body; and c. at least one securing member provided on the at least one waist securing portion to allow a user to easily wear or remove the apparel, said at least one securing member being hook and loop straps mounted on an inner side and an outer side of said outer portions, said at least one securing member on said inner side engaging and cooperating with said at least one securing member on said outer side when said outer portions overlap upon said apparel body being worn, additional of said at least one securing member being a button and a button loop, said button being adjacent to one of said hook and loop straps, said button loop being on an opposite of said outer portions to said button, said button loop extending outwardly and away from said at least one waist securing portion.

2. The apparel as claimed in claim 1, wherein the apparel is a skirt.

3. The apparel as claimed in claim 1, wherein the waist securing portion includes a resilient band, said resilient band extending entirely across said center portion.

4. The apparel as claimed in claim 1, wherein at least one pocket is provided on an operative inner surface of the apparel body, said at least one pocket being mounted on one of said outer portions and being parallel to said operative bottom edge.

5. The apparel as claimed in claim 2, wherein the skirt is at least one of a knee length skirt or a full length skirt.

6. The apparel as claimed in claim 1, wherein the inner surface of the apparel body is provided with a warmth providing material.

7. The apparel as claimed in claim 1, wherein said center portion includes a center portion width and said outer portions each include an outer portion width, said center portion width being greater than said outer portion width.

8. The apparel as claimed in claim 7, wherein a flap extends outwardly and away from said center portion.

9. The apparel as claimed in claim 7, wherein said flap is adjacent and parallel to said at least one waist securing portion.

10. The apparel as claimed in claim 1, wherein said hook and loop straps are mounted horizontally and are parallel to each other.

11. The apparel as claimed in claim 1, wherein said button is parallel to said hook and loop straps.

12. The apparel as claimed in claim 1, wherein said button is on a front side of one of said outer portions.

13. The apparel as claimed in claim 4, wherein said at least one pocket includes an open top face.

* * * * *